United States Patent [19]

Morikawa et al.

[11] 4,050,244

[45] Sept. 27, 1977

[54] CYLINDER HEAD

[75] Inventors: Nobutaka Morikawa, Aichi; Susumu Tanaka, Toyota, both of Japan

[73] Assignee: Toyota Jidosha Kogyo Kabushiki Kaisha, Toyota, Japan

[21] Appl. No.: 637,015

[22] Filed: Dec. 2, 1975

[30] Foreign Application Priority Data

Sept. 17, 1975 Japan ..... 50-111773

[51] Int. Cl.[2] ..... F01N 7/08

[52] U.S. Cl. ..... 60/282; 123/191 A; 123/193 H

[58] Field of Search ..... 60/272, 282, 322; 123/191 A, 193 H

[56] References Cited

U.S. PATENT DOCUMENTS

| | | | |
|---|---|---|---|
| 2,225,807 | 12/1940 | Towler | 123/188 GC |
| 3,559,401 | 2/1971 | Takahashi | 60/286 |
| 3,577,727 | 5/1971 | Warren | 60/292 |
| 3,902,853 | 9/1975 | Marsee | 60/322 |
| 3,916,850 | 11/1975 | Date | 60/322 |
| 3,983,696 | 10/1976 | Pflugfelder | 60/282 |

FOREIGN PATENT DOCUMENTS

| | | | |
|---|---|---|---|
| 2,323,793 | 11/1974 | Germany | 60/272 |

*Primary Examiner*—Douglas Hart

*Attorney, Agent, or Firm*—Stevens, Davis, Miller & Mosher

[57] ABSTRACT

A cylinder head including a tubular port liner made of a heat resistant metal, with an annular space interposed between the liner and the wall of a cavity in the cylinder head, whereby the heat to be transmitted from exhaust gases to the cylinder head is insulated by the annular space defined between the port liner and the wall of a cavity in the cylinder head. This tubular port liner is secured or embedded into the cylinder head itself at its one end on the side of a combustion chamber according to the so-called "insert" casting technique and flared at the other end on the side of an exhaust pipe so as to provide an intimate contact between the wall of a cavity in the cylinder head and the liner. The tubular port liner is formed on its lower part with a built-up, beaded portion which is fitted in a corresponding concave portion in the wall of the cavity in the cylinder head for preventing shifting of the liner due to thermal expansion or contraction.

5 Claims, 2 Drawing Figures

CYLINDER HEAD

BACKGROUND OF THE INVENTION

1. Field of the Invention

This invention relates to a cylinder head for use in an internal combustion engine and the like, and more particularly to a port liner which covers over the wall of a cavity in the cylinder head for insulating heat to be transmitted from exhaust gases to the wall of the cylinder head.

2. Description of the Prior Art

It has been common practice to use a port liner for a cylinder head in an attempt to insulate the heat being transmitted from exhaust gases to the cylinder head, which is being cooled with cooling water. This is because the temperature of exhaust gases should be maintained at a high temperature for effecting recombustion of exhaust gases in an exhaust system of an internal combustion engine, thereby purifying exhaust gases containing unburnt gaseous components.

Accordingly, such a port liner should be made of a metal having high heat resistance and relatively low heat conductivity. The port liner is installed within a cavity in a cylinder head in a manner to define an annular space between the wall of the cavity in the cylinder head and the port liner. Thus, the heat of exhaust gases flowing through the port liner may be insulated by means of the annular space defined therearound, so that the heat from exhaust gases will not be unfavorably transmitted to the cylinder head.

Meanwhile, the cavity or exhaust gas passage in the cylinder head, in general, follows a complex route, so that a port liner is generally formed into two halves, upper and lower, in the course of fabrication, and then those upper and lower halves are welded together along suitable edges or flanges to give a port liner of an integral construction.

Hitherto, the port liner is installed in the cylinder head by using the so-called "insert" or "filler" casting technique. More particularly, the port liner thus welded and hence of an integral construction is buried in a sand core beforehand, and then the core is placed in a cavity defined within the upper and lower halves of a casting mold, i.e., a cope and a drag, after which a melt is poured therein. Thus, the end of the port liner on one side is embedded in the inner wall of the cylinder head thus cast, while the other end of the port liner is freed. After cooling, the core sand is removed, thereby providing the annular space between the wall of a cavity in the cylinder head and the port liner. Then, the other end of the port liner is welded to the wall of a cavity in the cylinder head or sealed with a sealing part to confine the annular space completely. Such an attempt therefore dictates the use of a sealing part or welding, suffering from shortcomings of insufficient sealing accruing from the dimensional error or allowances of the sealing part and the port liner, and excessive man hours required for the fabrication of the cylinder head.

SUMMARY OF THE INVENTION

It is an object of the present invention to provide a cylinder head having a port liner, which is less in the number or built-in parts and hence reduces the man hours required for fabrication of the cylinder head.

It is another object of the present invention to provide a cylinder head having a port liner, which insures high heat insulation for the heat being transmitted from exhaust gases to the wall of a cavity of the cylinder head, thereby improving purifying performance for unburnt components contained in exhaust gases.

It is a further object of the present invention to provide a cylinder head having a port liner which insures positive but intimate sealing against the wall of the cavity in the cylinder head.

These and other objects and features of the present invention may be readily attained in a cylinder head having a tubular port liner which is made of a heat resistant metal, with an annular space interposed between the liner and the wall of a cavity in the cylinder head, whereby the heat to be transmitted from exhaust gases to the cylinder head is effectively insulated by means of the annular space.

According to one aspect of the present invention, the tubular port liner is secured or embedded in the wall of a cavity in the cylinder head itself at its one end on the side of a combustion chamber and flared at the other end on the side of an exhaust pipe so as to provide an intimate contact between the wall of a cavity in the cylinder head and the port liner.

According to another aspect of the present invention, the end of the port liner to be flared is formed along its opposite side edges with flanges having a relatively large area to accommodate themselves to the flaring working.

According to still another aspect of the present invention, the port liner is formed on its lower part or lower half with a built-up beaded portion which is to be fitted in the corresponding concave portion defined in the wall of a cavity in the cylinder head for preventing shifting of the liner due to thermal expansion or contraction.

DESCRIPTION OF THE PREFERRED EMBODIMENT

Figure 1:
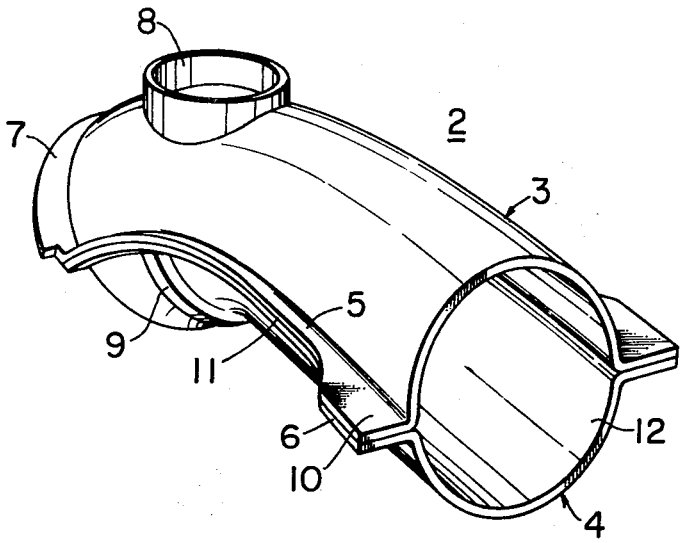
FIG. 1 is a perspective view of one embodiment of a port liner for use in a cylinder head, according to the present invention.

Referring now to FIG. 1, a port liner 2 includes two press-formed upper and lower halves 3, 4 having a half circle in cross section and made of a stainless steel. The upper and lower halves 3, 4 have flanges 5, 6 which extend along the parting plane of the upper and lower halves 3, 4 and are welded along their side edges so as to provide an integral construction as a port liner 2.

The first or upper half 3 is formed at its one end with a flange 7 extending radially outwardly, and flanges 5 extending outwardly along the parting plane from the opposite side edges thereof. The upper half 3 is formed with an opening 8 defined by a flange extending outwardly from the surface thereof. The flange 7 is provided at one end 18 of the upper half 3. The second or lower half 4 of the port liner is formed with flanges 6 extending outwardly from the opposite side edges thereof. The flanges 6 are exactly of the same shape as that of the flanges 5 so as to register therewith for welding. The lower half 4 is formed with a built-up beaded portion 9 of a half circle in cross section on its outer surface which is to be fitted in a concave portion defined in the wall of a cavity in the cylinder head. In this respect, those portions 10 of the flanges 5 and 6 which are located on the side of the other end 12 of the upper and lower halves 3, 4 have widths larger than those of the other portions of the flanges 5 to accommodate themselves to the subsequent flaring working. More particularly, the upper and lower halves 3, 4 are welded along their edges 11 and then cast together with the cylinder head by utilizing the so-called "insert" casting technique. After the removal of the core sand, the end of the port liner 2 at the end 12 is flared. At this time, the aforesaid wider flanges 10 allow the smooth flaring of the end of the port liner.

The flanges 5 of the upper half 3, the lower half 4, the beaded portion 9 and the flange 7 of the upper half 3 are embedded in the wall of a cavity in the cylinder head, when cast. Thus, the beaded portion 9 and the flange 7 prevent shifting of the port liner 2 in the axial direction, when the port liner is subjected to the flaring working, so that the port liner 2 is retained in position on the wall 17 of the cylinder head, despite repeated thermal expansion and contraction.

Figure 2:
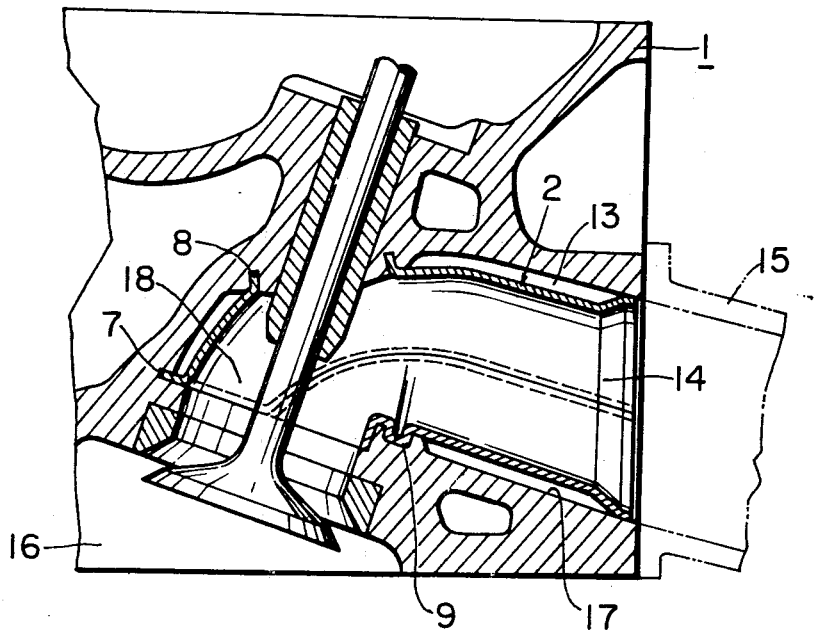
FIG. 2 is a cross sectional view of the cylinder head, in which the port liner is built, according to the present invention.

FIG. 2 shows a cross sectional view of one embodiment of the port liner 2 according to the present invention, in which the port liner is built in the cylinder head 1. In this figure, the port liner has been flared at its end 12 in a manner described earlier, after the removal of the core sand. The end 12 of the port liner is flared by means of a rigid punch or a spinning roller so as to provide an intimate contact between the port liner 1 and the wall 17 of a cavity in the cylinder head 1, thereby defining a heat-insulating annular space or chamber 13. In addition, the flange 7 and the beaded portion 9 are also shown embedded in the wall 17 of the cylinder head 1 in a rigid relation. Shown at 15 is an exhaust pipe, and at 16 a combustion chamber. In this manner, there is defined an exhaust gas passage 14 within the port liner 2. Thus, the heat of exhaust gases will not be transmitted to the wall of a cavity in the cylinder head 1 by the presence of an air space of chamber 13 which is thus confined by the inner wall of the cylinder head and the port liner.

As is apparent from the foregoing description of the cylinder head having a port liner according to the present invention, the number of parts to be built in the port liner may be reduced, while presenting a tightly confined air chamber or annular space between the wall of a cavity in the cylinder head and the port liner as well as an improved purifying performance for unburnt components contained in exhaust gases.

It will be understood that the above description is merely illustrative of the preferred embodiments of the invention. Additional modifications and improvements utilizing the discoveries of the invention can be readily anticipated by those skilled in the art from the present disclosure, and such modifications and improvements may fairly be presumed to be within the scope and purview of the invention as defined by the claims that follow.

What is claimed is:

1. A cylinder head having a cavity defined therein, one end of said cavity opening into a combustion chamber and the other end thereof opening into an exhaust pipe, a tubular port liner made of heat-resistant material positioned in said cavity with an annular space between the liner and the wall of the cavity, one end of said liner being adjacent said one end of said cavity and being rigidly secured to said cylinder head, the other end of said liner being adjacent the other end of the cavity and being flared to provide intimate contact between the liner and the wall of the cavity, said tubular port liner comprises upper and lower halves, each of which is semi-circular in cross-section, said upper and lower halves each having flanges of identical configuration extending outwardly from and along the edges thereof, and said flanges have portions at the other end of the liner which are wider than the other portions thereof.

2. A cylinder head having a cavity defined therein, one end of said cavity opening into a combustion chamber and the other end thereof opening into an exhaust pipe, a tubular port liner made of heat-resistant material positioned in said cavity with an annular space between the liner and the wall of the cavity, one end of said liner being adjacent said one end of said cavity and being rigidly secured to said cylinder head, the other end of said liner being adjacent the other end of the cavity and being flared to provide intimate contact between the liner and the wall of the cavity, said tubular port liner comprises upper and lower halves, each of which is substantially semi-circular in cross-section, said upper and lower halves each having flanges extending substantially radially outwardly from and along the edges thereof, the one end of said upper half being embedded in the wall of the cavity in the cylinder head, and a portion of the lower half adjacent the one end thereof comprises an outwardly projecting beaded portion rigidly fitted in a corresponding concave portion defined in the wall of the cavity.

3. A cylinder head having a tubular port liner therein as claimed in claim 1, wherein the one end of said upper half is embedded in the wall of the cavity in the cylinder head, and a portion of the lower half adjacent the one end thereof comprises an outwardly projecting beaded portion rigidly fitted in a corresponding concave portion defined in the wall of the cavity.

4. A cylinder head having a tubular port liner therein as claimed in claim 3, wherein said upper half comprises a further flange extending outwardly at the one end thereof, and said further flange is embedded in the wall of the cavity in the cylinder head.

5. A cylinder head having a tubular port liner as claimed in claim 2, wherein said upper half comprises a further flange extending outwardly at the one end thereof, and said further flange is embedded in the wall of the cavity in the cylinder head.

* * * * *